US006004251A

United States Patent [19]

Herrin

[11] Patent Number: 6,004,251

[45] Date of Patent: Dec. 21, 1999

[54] PLASTIC SHEETS WITH SCORING LINES

[75] Inventor: H. Scott Herrin, Rydal, Pa.

[73] Assignee: Klearfold, Inc., Warrington, Pa.

[21] Appl. No.: 08/906,820

[22] Filed: Aug. 6, 1997

[51] Int. Cl.[6] ..... B31B 1/25

[52] U.S. Cl. ..... 493/59; 493/63; 493/160; 493/404

[58] Field of Search ..... 493/59, 63, 64, 493/66, 396, 404, 402, 160, 161; 83/660, 663

[56] References Cited

U.S. PATENT DOCUMENTS

| | | | |
|---|---|---|---|
| 3,916,749 | 11/1975 | Armelin . | |
| 4,351,210 | 9/1982 | McKindary | 83/663 |
| 4,596,541 | 6/1986 | Ward, Sr et al. | 493/59 |
| 5,240,755 | 8/1993 | Zimmer . | |
| 5,302,435 | 4/1994 | Hashimoto . | |
| 5,537,905 | 7/1996 | Zimmer et al. . | |
| 5,582,571 | 12/1996 | Simpson et al. | 493/402 |
| 5,599,267 | 2/1997 | Dupuy | 493/59 |

FOREIGN PATENT DOCUMENTS

| | | | |
|---|---|---|---|
| 2705273 | 11/1994 | France | 493/160 |
| 0024195 | 3/1978 | Japan | 493/396 |
| 63-91455 | 6/1988 | Japan . | |
| 64-40317 | 2/1989 | Japan . | |
| 1-141720 | 6/1989 | Japan . | |
| 2-249626 | 10/1990 | Japan . | |

OTHER PUBLICATIONS

Zimmer Industries, Inc. Micromax Microperforating Rules.

Zimmer Rule of Production No. 517.

Zimmer Special Products and Capabilities Release No. C717.

Zimmer Industries, Inc. Perforating Rule Selection & Strength Guide.

*Primary Examiner*—Eugene L. Kim

*Attorney, Agent, or Firm*—Lerner, David, Littenberg, Krumholz & Mentlik, LLP

[57] ABSTRACT

A plastic blank for packaging and a method of making same is disclosed. The blank includes a score line having high and low portions such that the total length of a high portion plus the total length of a low portion is about 1/6s inch or less. The low portions may be holes and preferably the plastic is polyester.

9 Claims, 4 Drawing Sheets

PLASTIC SHEETS WITH SCORING LINES

BACKGROUND OF THE INVENTION

Boxes and similar three-dimensional packages are often manufactured by first cutting a flat sheet of plastic, cardboard or paper into a shape which can be folded into a box. These flat shapes are commonly referred to as "blanks." It has long been known that the use of performed creases known as "score lines" allows blanks to be easily folded. By creasing the blank, the manufacturer or packager can fold the blank precisely where it should be folded. For example, U.S. Pat. No. 5,599,267 discloses, among other things, lining up score lines in plastic sheets with score lines in cardboard blanks to create cardboard boxes having windows which extend around two sides of a box.

While score lines may have been in use for quite some time, a number of disadvantages still surround prior attempts to inexpensively and easily create score lines, particularly in blanks made out of certain plastics. For example, many systems heat the plastic blank during scoring by means of heated platens and rules or using RF fields. Although a high-quality score results from such a process, the heating step results in added expense, increased safety considerations and slower production rates.

U.S. Pat. No. 5,302,435 discloses a plastic sheet with a ruled line for bending. The ruled line is a groove which has shallow and deep recess portions running along the length of the groove. In other words, the groove has alternating and generally-rectangular "hills" and "valleys" extending in the direction of the groove. The shallow portions are "chamfered" at the edges so that the generally rectangular hills have rounded edges which give the groove "a good touch feel." The chamfer is apparently necessary because, at the size ranges taught by the patent (0.3–1.5 mm), the edges of the shallow portions will not "have a good touch feel" when the package is bent at the scoring line. JP 64-40317, an earlier reference by the same applicant as the patent, also discloses a plastic sheet with a ruled line for bending and similarly-sized deep portion lengths (0.1–2.0 mm) and shallow portion lengths (0.3–3.0 mm). Both references suffer from the further disadvantage that the score line is visually distracting because the score line actually appears to be a perforation.

Accordingly, none of the foregoing references teaches an efficient manner of placing relatively smooth score lines in plastic blanks without the need to heat or specifically chamfer the high and low portions in the groove. There is, therefore, a need for blanks and a process for making same which overcomes these disadvantages.

The present invention meets these needs.

SUMMARY OF THE INVENTION

It has been discovered that particular rules which have been traditionally used in the past to cut or perforate cardboard or plastic may be used instead to create score lines in plastic blanks which overcome the foregoing disadvantages. While traditional perforating rules may have been used on occasion to score, they have not been able to overcome the disadvantages mentioned above. Moreover, perforating rules are traditionally configured so that even if a score line is formed, the scored material becomes easily separated at the score line, which severely limits the use of such material. However, it has been discovered that by setting the teeth of such rules to very specific dimensions and characteristics, the disadvantages of even those prior art rules specifically intended for scoring are overcome.

By way of example, the dimensions and characteristics of the rule must be such that the resulting score line in a plastic blank has high portions extending from the bottom side of the blank towards the top side, low portions extending from the bottom side towards the top side for a distance less than that of the high side, and the average lengths of a high portion plus a low portion are about 1/65 inch or less.

In one preferred embodiment of the present invention, the plastic blank for packaging has a top and bottom side separated by a thickness and a score line for folding the blank at the score line. The score line extends in a longitudinal direction and includes high and low portions, the high portions extending from the bottom side towards the top side for a high distance and the low portions extending from the bottom side towards the top side for a low distance, the low distance being less than the high distance. The high and low portions alternate in the longitudinal direction. The average distance between the midpoint of a high portion and the midpoint of an adjacent low portion is about 1/130 inch or less. Preferably, the average distance between the midpoints is less than about 1/140 inch and, even more desirably, is less than about 1/200 inch.

In another preferred embodiment of the present invention, the average total length of a high portion plus a low portion in the longitudinal direction is the teeth period and the teeth period is about 1/65 inch or less. Preferably, the teeth period is about 1/70 inch or less and, even more desirably, is about 1/100 inch or less.

In yet another preferred embodiment of the present invention, the average total length of a high portion is less than about 1/130 inches, such as about 1/140 inches or about 1/200 inch or less.

In a further preferred embodiment of the present invention, the average number of high portions per inch in the longitudinal direction is greater than about 65 and the average number of low portions per inch in the longitudinal direction is greater than about 65. Preferably, the average number of high portions per inch in the longitudinal direction is greater than about 70 and, more desirably, greater than about 100.

Preferably, the low portions constitute holes which extend completely through the plastic. These holes are disposed adjacent to the high portions in the longitudinal direction.

The blank may be made of a number of different plastics. By way of example, the blank may be polyester, polyethylene, polyethylene terepthalate (PET), polyvinyl chloride or polypropylene.

The heights of the portions are variable. For example, the high portion may extend completely to the top side of the blank. The thickness of the blank may also be less at the score line than the remainder of the blank, such that the high portion extends to spaced distance from both the top and the bottom sides of the blank.

In another embodiment of the present invention, a method is provided for placing a score line in a plastic blank for packaging. The method comprises providing a rule having alternating teeth and spaces extending in a longitudinal direction such that the average total length in the longitudinal direction of a tooth plus the length in the longitudinal direction of a space is about 1/65 inch or less. A plastic blank is also provided having a top side and a bottom side separated by the thickness of the plastic blank. The teeth are pressed into the blank for a predetermined distance to create a score line such that the predetermined distance is sufficient to create high and low portions within the score line in the longitudinal direction. Preferably, the average total length in the longitudinal direction of a tooth plus the length in the longitudinal direction of a space is about 1/70 inch or less or about 1/100 inch or less.

In a still further embodiment of the present invention, a method for placing a score line in a plastic blank for packaging includes providing a rule having alternating teeth and spaces extending in a longitudinal direction, the average number of teeth per inch in the longitudinal direction being greater than about 65. A plastic blank having a top side and a bottom side separated by the thickness of the plastic blank is also provided. The teeth are pressed into the blank for a predetermined distance to create a score line, the predetermined distance being sufficient to create high and low portions within the score line in the longitudinal direction. Preferably, the average number of teeth per inch in the longitudinal direction is greater than about 70 and, even more desirably, greater than about 100.

Preferably, the low portions comprise holes in the blank and the high portions extend from the bottom side to the top side. The rule may also be disposed upon a rotary die.

DETAILED DESCRIPTION OF THE PREFERRED EMBODIMENTS

Figure 1:
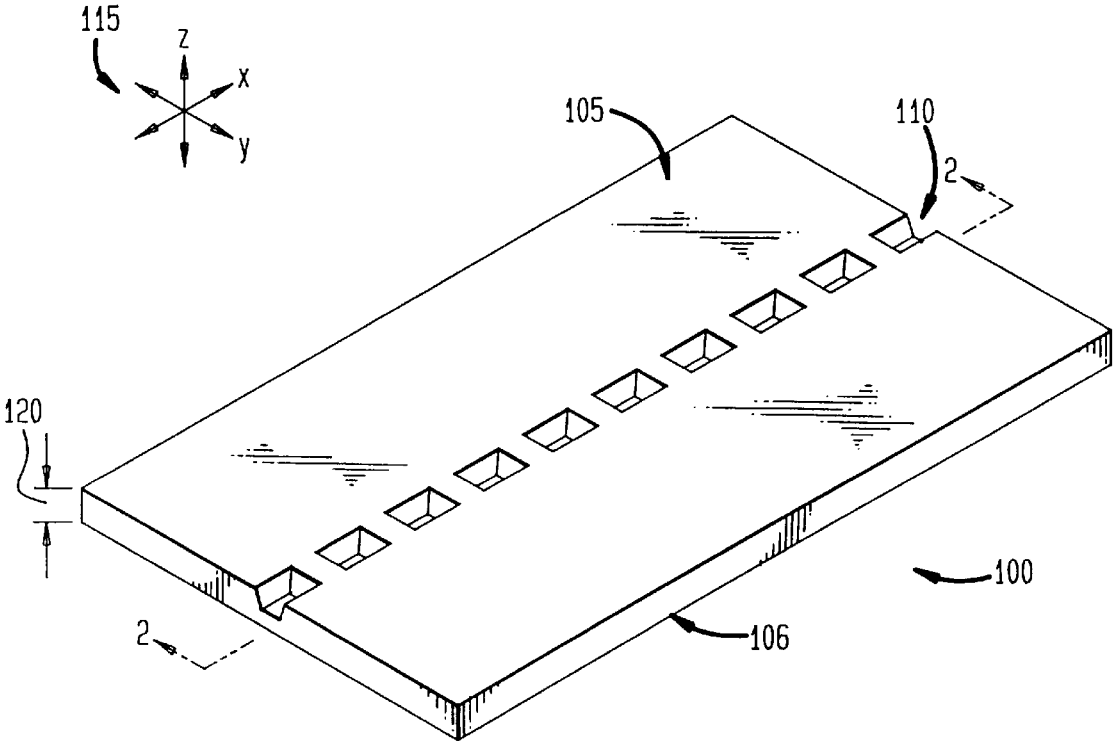
FIG. 1 is a schematic diagram of a portion of a blank having a score line in accordance with a first preferred embodiment of the present invention.

FIG. 1 discloses a plastic blank 100 including a score line 110 for bending the blank along the score line (none of the figures of the present application are intended to be to scale but are rather drawn for ease of reference). The blank has a top side 105 and a bottom side 106. The score line extends in a longitudinal direction which, for reference purposes only is illustrated by compass 115 as being in the x direction. The blank has a thickness 120 which extends in the z direction between the top and bottom sides 105, 106. Typically, the thickness of the plastic blank is between about 0.006 and 0.020 in. It must be understood that the references to the different directions and terms such as "top" and "bottom" are for ease of reference only. By way of example, whether the score line is on the "top" or "bottom" of a sheet of material, the material could be folded into a box so that the score line is either on the outside or inside of the box.

Figure 2:
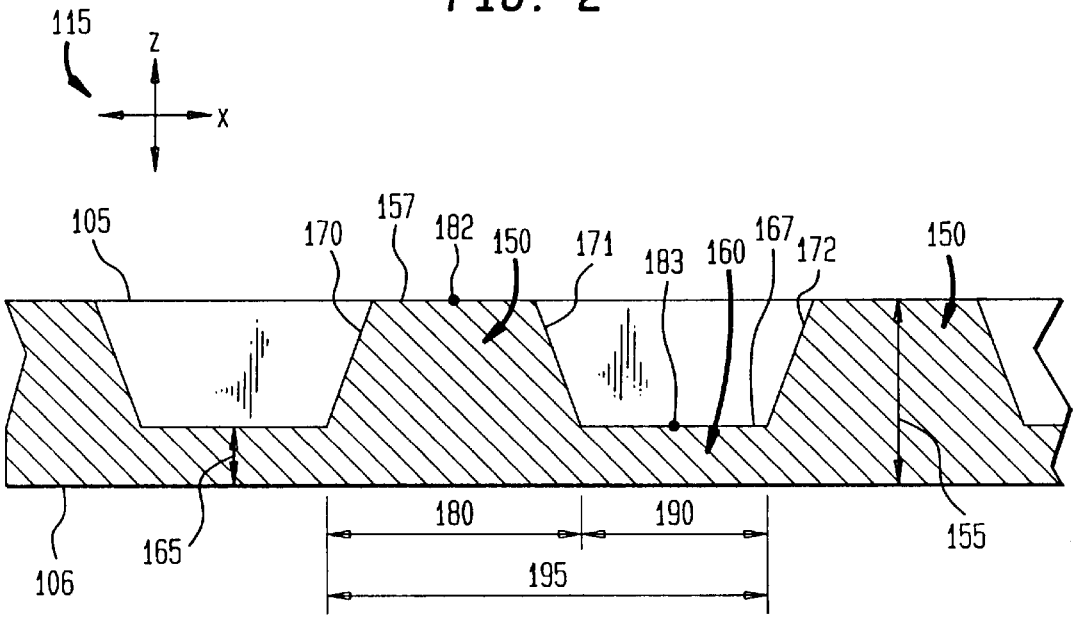
FIG. 2 is a cross-section of a portion of a blank having a score line in accordance with the first preferred embodiment of the present invention.

A partial cross-section of the score line 110 taken along its longitudinal length is shown in FIG. 2. Alternating high and low portions 150 and 160, respectively, extend along the fold line in its longitudinal (x) direction. Both the high and low portions extend from the bottom side 106 towards the top side 105, but for different distances. For example, the height 155 of the high portions 150 in the z direction is equal to the thickness 120 (FIG. 1) of the blank. In other words, high portion 150 extends from the blank's bottom side 106 to the top 105.

The low portions 160 also extend in the z direction from bottom side 106 towards top side 105. However, the height 165 of low portions 160 is less than the height 155 of high portion 150.

As shown in the preferred embodiment of FIGS. 1 and 2, the tops 157, 167 of the high and low portions 150, 160, respectively, are generally flat planes. The transition between the tops of the low and high portion is preferably gradual, so that high portion 150 has sloping sides 170 and 171. The sloping sides give high portion 150 a generally trapezoidal shape.

Each portion, high or low, has a length in the longitudinal direction. For example, the length 180 of high portion 150 is the sum of the lengths of the top side 157 and the longitudinal distance of its adjacent sloping sides 170 and 171. As the sloping sides 170 and 171 are considered to be part of the high portion, the length 190 of the low portion 160 is simply the length of the low portion top 167. Together, the sum of these two lengths is defined herein as the "teeth period" and is shown in FIG. 2 as dimension 195. Due mostly to manufacturing tolerances, the lengths of the various high and low portions in the score line may vary. Accordingly, the teeth period is further defined as the average of the length of any high portion plus the length of any low portion.

It will be noted that as long as the high portions are all generally the same length and the low portions are all generally the same length, and as long as every point of the score line in the longitudinal direction is consistently allocated to either a high or low portion, then the teeth period will not depend on how high the high and low portions are or how they are shaped. In other words, as long as every point above or equal to a certain threshold height is allocated to the high portion and every point below the threshold is allocated to a low portion, then the teeth period will not depend on the threshold height. For instance, if the threshold height is considered to be the thickness of the blank, then the low portion will include low portion top 167 and sloping sides 170 and 171, and the high portion will include only high portion top 157. Although the dimensions 180 and 190 in FIG. 2 may change, the overall teeth period 195 will remain the same.

The high and low portions also have midpoints in the longitudinal direction, the midpoints being halfway between the respective portions' lengths. For example, the midpoint 182 of high portion 150 is the midpoint of top 157 if the longitudinal lengths of sloping sides 170 and 171 are equal.

Figure 3:
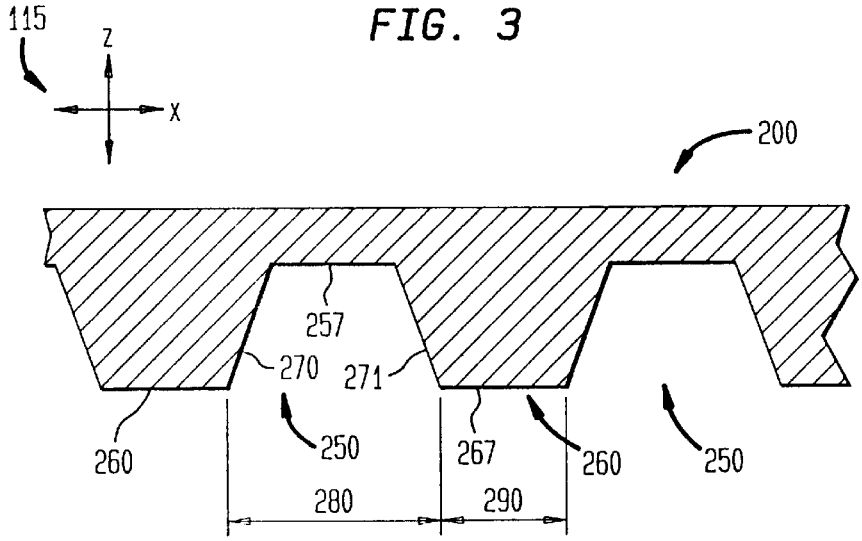
FIG. 3 is a cross-section of a portion of a rule for creating a score line in accordance with the first preferred embodiment of the present invention.
Figure 4:
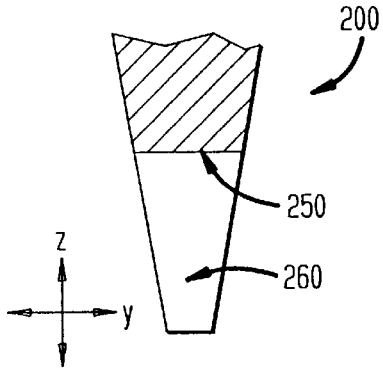
FIG. 4 is a cross-section of a portion of the rule of FIG. 3.
Figure 5:
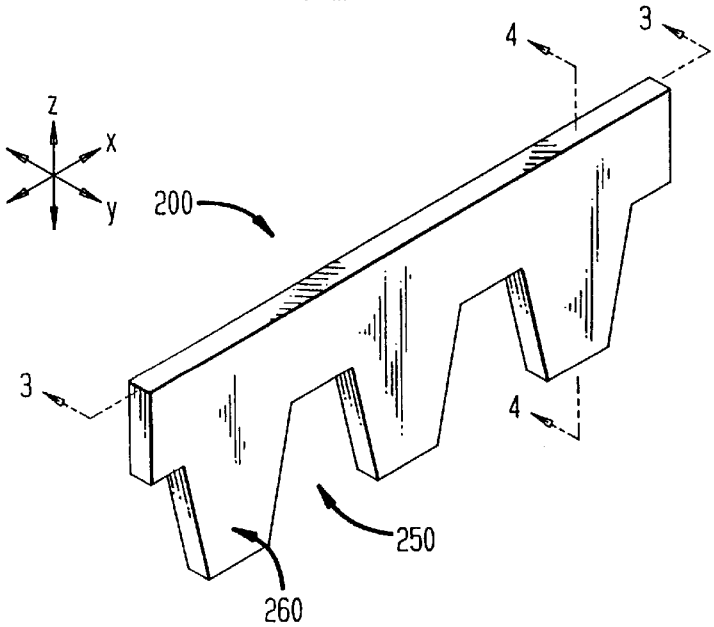
FIG. 5 is a schematic diagram of a portion of a rule of FIG. 3.

A portion of a rule for making a fold line in accordance with the present invention is shown in FIGS. 3–5. Rule 200 has a plurality of teeth 260 separated by spaces or notches 250. The teeth and spaces extend in the same longitudinal (x)

direction as the score line. In the preferred embodiment of FIG. 3, the teeth 260 extend down in the z direction to a flat bottom 267. The length of the flat bottom 267 in the longitudinal direction is considered the tooth length 290. The teeth also have sloping sides 270 and 271 which, together with a flat top 257, define space 250. The length 280 of the space 250 is defined as the longitudinal distance of the sloping sides 270 and 271 as well as the flat top 257. The rule need not be a traditional straight rule as used in flat dies, but may also be a rotary die where the pattern is chemically milled or machined from solid metal onto a cylinder which rotates to create the score lines. Such a rotary die is shown in FIG. 18 of U.S. Pat. No. 5.302,435.

Preferably, as shown in FIG. 4, the rule 200 tapers in the y direction as it extends downward in the z direction. This taper allows the rule to more easily enter the blank.

Figure 6:
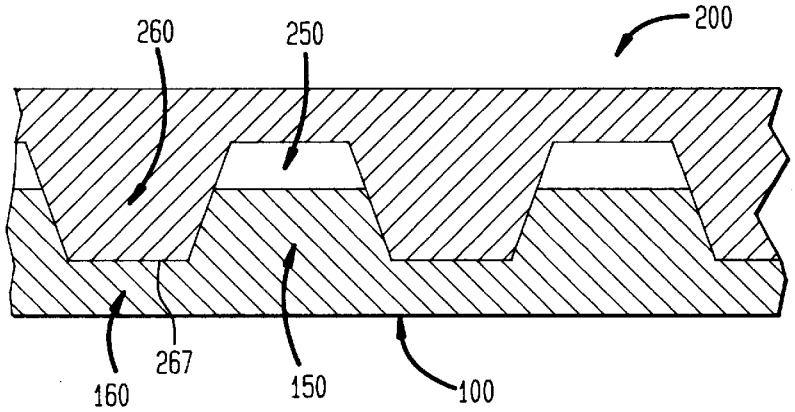
FIG. 6 is a cross-section of a portion of a rule creating a score line in a portion of a blank in accordance with one preferred embodiment of the present invention.

In operation and as shown in FIG. 6, the rule 200 is pressed into blank 100 to create the score line 110. When the rule is removed, the plastic blank will reflect the impression left by the rule. The size of the low portions 160 will correspond with the size of teeth 260. The size of the high portions 150 will correspond with the size of the spacers 250 and how far the rule 200 is pressed into blank 100. If the rule 200 is not pushed all the way through the thickness of the blank 100 thus creating a hole, the length of the low portion 160 will be about equal to the tooth length 290 of the bottom 267 of tooth 260.

It has been discovered that, if the lengths of the teeth and spacers are set at specific dimensions and used with plastic blanks, then the impression left by such a rule which is partially pressed into the blank has unique characteristics which overcome many of the disadvantages of the prior art. For example, the dimensions of rule 200 are chosen so that there are at least 65 teeth/inch, and preferably at least 70 teeth per inch. This results in a teeth period (total length of the tooth 260 plus space 250) of no more than 1/70 inch (0.01428 in. –0.357 mm) and an average distance between midpoints of high and low portions of 1/140 (–0.00714 in). An acceptable rule at such dimensions would be MicroMax™ Microperforating Rule Item No. JR offered by Zimmer Industries, Inc.

At these dimensions, the resulting high and low portions 150 and 160 will be sufficiently close together so that the high and low portions do not create an unacceptably jagged or rough feel regardless of the shape of the portions. Thus, for example, there is no need to chamfer the edges as disclosed by the reference listed in the background. In addition, the small teeth period lacks the perforated look attendant to score lines typical of prior art rules as discussed in the background. At the same time, the presence of spacers 250 provides a space for the plastic web to flow into when the rule presses into the web, which allows the rule to be used without heating. Without the spacers, the plastic blank is likely to bulge or warp.

Preferably, the dimensions of the teeth are chosen so that the high and low portions of the fold line are densely packed, but not so close so that the plastic is prevented from rising into the spacers when the rule is inserted in the blank. It has been determined that the optimal tooth period is equivalent to 100 teeth/inch, which results in a tooth period of 0.010 in. and an average distance between midpoints of high and low portions of 0.005 in.

The optimum dimensions of the high and low portions, as well as how far the rule is pushed into the blank, is also dependent upon the plastic being scored. For example, the tear resistance of the plastic affects not only how far the rule should be pushed into the blank, but also how efficient the present invention is. For example, polyvinyl chloride has a very low tear strength and, therefore, if the length of the high portions is too thin and the number of teeth per inch is too high, then the score line may separate upon folding. On the other hand, polyesters such as polyethylene terepthalate (PET) and particularly amorphous PET (APET), recycled PET, PETG (glycol) and co-extrusions of these materials, have a very high tear strength and are particularly well-suited for use in connection with the present invention. Other acceptable plastics include other polyethylene and polypropylene. Another factor affecting size and teeth/inch considerations includes the thickness of the plastic.

Figure 7:
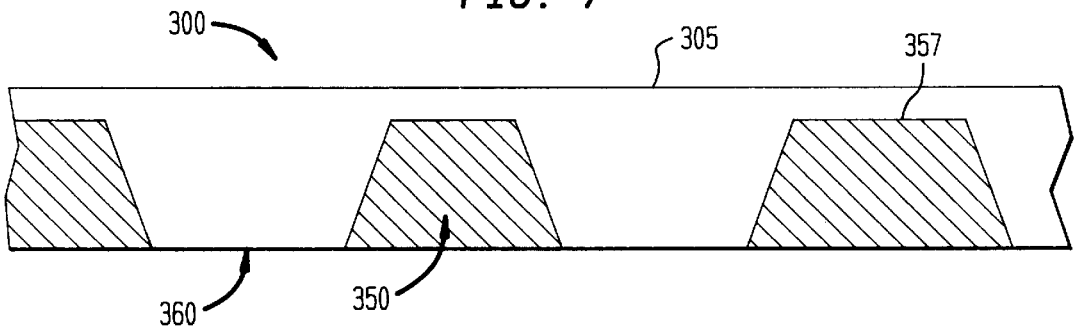
FIG. 7 is a cross-section a portion of a blank having a score line in accordance with a second preferred embodiment of the present invention.

Rather than pushing the teeth 260 of rule 200 only partly through the blank 100 to create a fold line, the teeth 260 may also be pushed all the way through to create holes. For example, in the second preferred embodiment shown in FIG. 7, the low portions are holes 360. Moreover, the heights of the high portions 350 are less than the thickness of the blank such that the tops 357 of high portions 350 are below the top side 305 of the blank 300. When holes are present in the score line, the "holding percentage" becomes a relevant consideration. The holding percentage is the ratio of the length of the holes to the length of the high portions in the longitudinal direction of the score line. Thus, if the length of the high portions are equal to the lengths of the holes, then the holding percentage would be 50%. If the lengths of the holes are less than the lengths of the high portions, then the holding percentage would be more than 50%. Generally, as the holding percentage increases, the strength of the fold line also increases but the ease of bending the blank at the fold line decreases. Therefore, in accordance with the present invention, if the hold percentage is set at about 50%, then the length of high portion 350 will be less than or about 1/(65 * 2) or 1/135 in. (–0.0077 in) at 65 teeth/inch or more.

Figure 8:
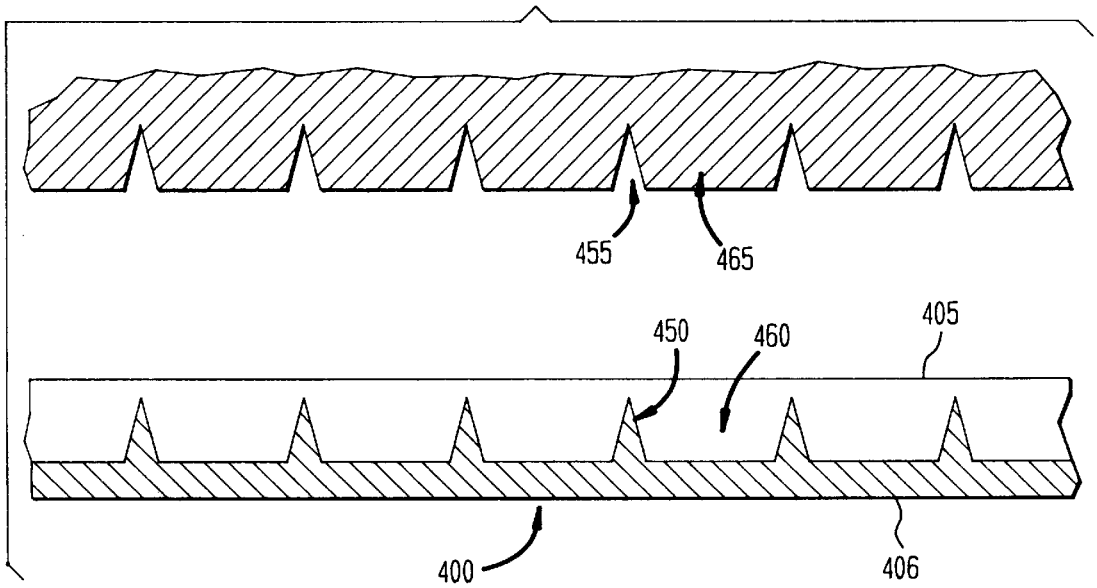
FIG. 8 is a cross-section of a portion of a rule and a blank having a score line in accordance with a third preferred embodiment of the present invention.

Many other shapes are possible for the high and low portions. As shown in the third preferred embodiment of FIG. 8, the spaces 455 of the rule may not have flat tops but may instead be V-shaped notches. If so, and if the tops of the spaces 455 are completely pressed into the blank but not so far that the bottom of the teeth 465 protrude through the bottom 406 of blank 400, then high portions 450 will also be V-shaped. Similarly, if the teeth 460 were made into other shapes (such as, for example, curved and/or convex and concave shapes), the high and low portions would likewise reflect the shape of those teeth.

Figure 10:
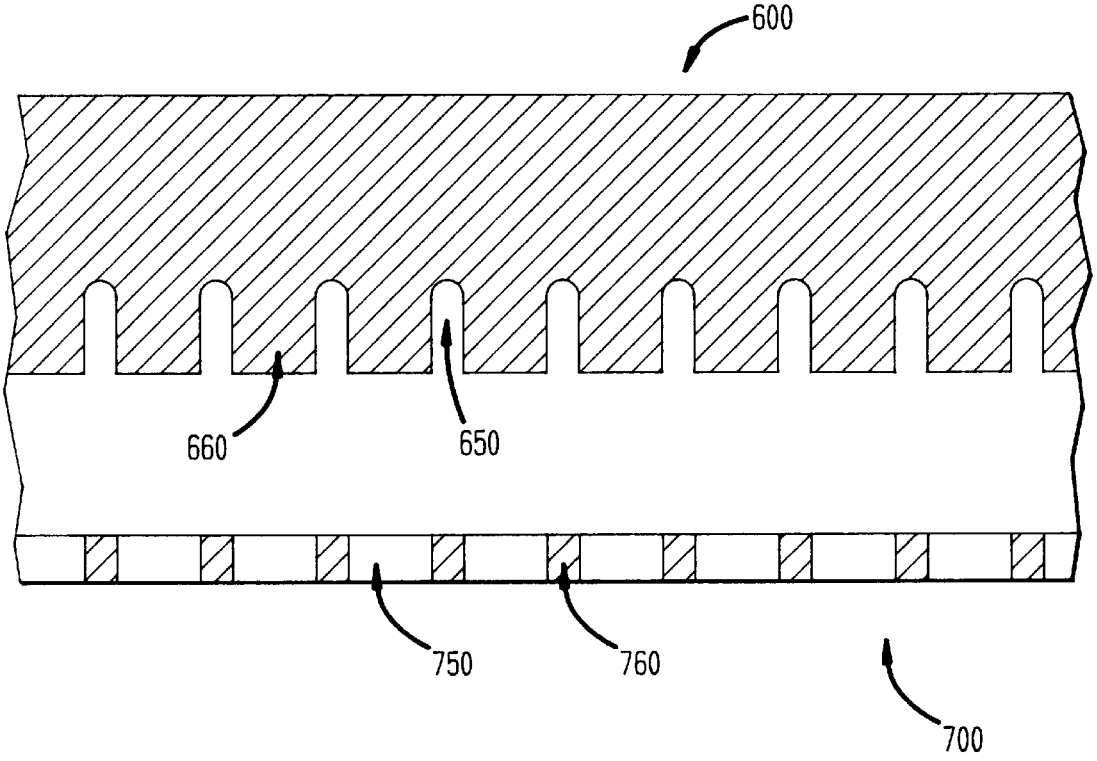
FIG. 10 is a cross-section of a portion of a rule and a blank having a score line in accordance with a fifth preferred embodiment of the present invention.

In the event a MicroMax™ Microperforating Rule Item No. JR is used, the shape of the teeth 660 of rule 600 are square as shown in FIG. 10. In this embodiment, the high portions 760 extend from the bottom to the top of the plastic 700 and the low portions 750 comprise holes. The shape of the notches 650 of the rule are U-shaped.

In addition, the score line need be made only in one side of the blank. For example, as is well known in the art as suggested by FIG. 13, U.S. Pat. No. 5,302,435, the score line could be made in both sides of the blank. In this instance the thickness of the blank at the score line will be less than the remainder of the blank.

Figure 9:
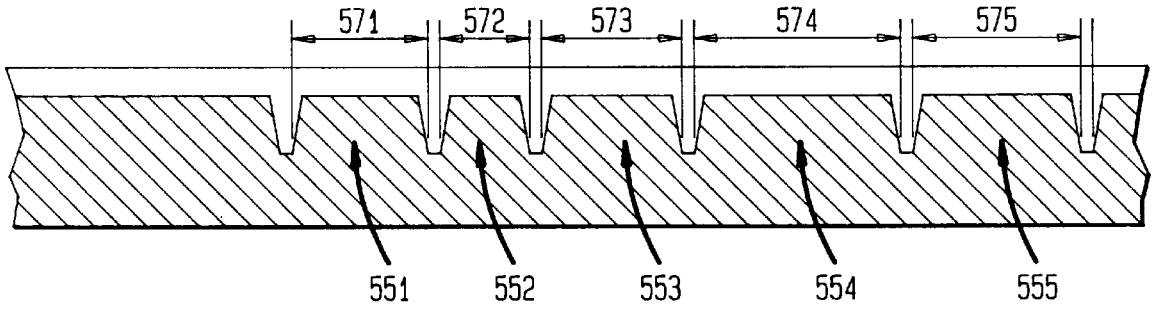
FIG. 9 is a cross-section a portion of a blank having a score line in accordance with a fourth preferred embodiment of the present invention.

In the fourth preferred embodiment, the teeth period of the rule varies between neighboring high and low portions. By way of example and as shown in FIG. 9, the high portions 551–555 may have varying lengths such that the length of any particular high portion is either less than, greater than or about equal to the other high portions. The lengths may vary in accordance with a predetermined formula or be random. In any event, for any given length of the score line, the teeth period remains the average of the lengths of the high portions and the low portions in the longitudinal direction.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

I claim:

1. A method for placing a score line in a plastic blank for packaging comprising:

a) providing a rule having alternating teeth and spaces extending in a longitudinal direction, the average total length in said longitudinal direction of a tooth plus the length in said longitudinal direction of a space being approximately 1/65 inch or less, b) providing a plastic blank having a top side and a bottom side separated by the thickness of said plastic blank, c) pressing said teeth into said blank for a predetermined distance to create a score line, said predetermined distance sufficient to create high and low portions within said score line in said longitudinal direction so that said high and low portions do not create an unacceptably jagged or rough feel without the need of chamfered edges.

2. The method of claim 1 wherein the average total length in said longitudinal direction of a tooth plus the length in said longitudinal direction of a space is about 1/70 inch or less.

3. The method of claim 2 wherein the average total length in said longitudinal direction of a tooth plus the length in said longitudinal direction of a space is about 1/100 inch or less.

4. A method for placing a score line in a plastic blank for packaging comprising:

a) providing a rule having alternating teeth and spaces extending in a longitudinal direction, the average number of teeth per inch in said longitudinal direction being greater than approximately 65, b) providing a plastic blank having a top side and a bottom side separated by the thickness of said plastic blank, c) pressing said teeth into said blank for a predetermined distance to create a score line, said predetermined distance sufficient to create high and low portions within said score line in said longitudinal direction so said high and low portion do not create an unacceptably jagged or rough feel without the need of chamfered edges.

5. The method of claim 4 wherein the average number of teeth per inch in said longitudinal direction is greater than about 70.

6. The method of claim 5 wherein the average number of teeth per inch in said longitudinal direction is greater than about 100.

7. The method of claims 1 or 4 wherein said low portions comprise holes in said blank.

8. The method of claims 1 or 4 wherein said high portions extend from said bottom side to said top side.

9. The method of claim 1 or 4 wherein said rule is disposed upon a rotary die.

* * * * *

UNITED STATES PATENT AND TRADEMARK OFFICE

CERTIFICATE OF CORRECTION

PATENT NO. : 6,004,251

DATED : December 21, 1999

INVENTOR(S) : H. Scott Herrin

It is certified that error appears in the above-identified patent and that said Letters Patent is hereby corrected as shown below:

Column 8, line 14, after "so" insert --that--.

Signed and Sealed this

Fifth Day of September, 2000

*Attest:*

Q. TODD DICKINSON

*Attesting Officer*

*Director of Patents and Trademarks*